US010801482B2

(12) United States Patent
Xiao et al.

(10) Patent No.: US 10,801,482 B2
(45) Date of Patent: Oct. 13, 2020

(54) MULTIPHASE PRODUCTION BOOST METHOD AND SYSTEM

(71) Applicant: Saudi Arabian Oil Company, Dhahran (SA)

(72) Inventors: Jinjiang Xiao, Dhahran (SA); Shoubo Wang, Broken Arrow, OK (US)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 502 days.

(21) Appl. No.: 14/956,643

(22) Filed: Dec. 2, 2015

(65) Prior Publication Data

US 2016/0160852 A1 Jun. 9, 2016

Related U.S. Application Data

(60) Provisional application No. 62/088,749, filed on Dec. 8, 2014.

(51) Int. Cl.
*F04B 39/00* (2006.01)
*F04B 39/06* (2006.01)
(Continued)

(52) U.S. Cl.
CPC ..... *F04B 39/0011* (2013.01); *E21B 21/067* (2013.01); *E21B 43/34* (2013.01);
(Continued)

(58) Field of Classification Search
CPC ..... E21B 43/34; E21B 43/36; E21B 21/067; F04F 1/18; F04B 9/10; F04B 9/103; F04B 23/08; Y10T 137/86155
(Continued)

(56) References Cited

U.S. PATENT DOCUMENTS 1,929,350 A * 10/1933 Christensen ..... F04B 39/0011 417/54
4,066,123 A * 1/1978 Skinner ..... E21B 43/12 166/68.5
(Continued)

FOREIGN PATENT DOCUMENTS

DE 4430716 A1 3/1996
WO 9219924 A1 11/1992
WO WO-9219924 A1 * 11/1992 ..... F04B 39/0011

OTHER PUBLICATIONS

International Search Report and Written Opinion for related PCT application PCT/US2015/064391 dated Mar. 30, 2016.
(Continued)

*Primary Examiner* — Christopher S Bobish
(74) *Attorney, Agent, or Firm* — Bracewell LLP; Constance G. Rhebergen; Linda L. Morgan

(57) ABSTRACT

A system and method for boosting the pressure of a low-pressure multiphase mixture into a high-pressure multiphase mixture. The system includes a gas-liquid separator, a liquids pump and a liquid piston compressor. The method includes introducing the low-pressure multiphase mixture into the pressure boost system, operating such that a low-pressure liquid and a low-pressure gas form, boosting the pressure of the low-pressure liquid to a high-pressure liquid, introducing low-pressure gas during a charging period into the liquid piston compressor, converting the low-pressure gas into high-pressure gas using the high-pressure liquid during a compression period, discharging the high-pressure gas form the liquid piston compressor, and mixing the high-pressure liquid and gas such that the high-pressure multiphase mixture.

11 Claims, 5 Drawing Sheets

(51) Int. Cl.

| | |
|---|---|
| ***F04B 9/103*** | (2006.01) |
| ***E21B 43/36*** | (2006.01) |
| ***F04B 49/00*** | (2006.01) |
| ***E21B 43/34*** | (2006.01) |
| ***E21B 21/06*** | (2006.01) |
| ***F04B 23/08*** | (2006.01) |

(52) U.S. Cl.
CPC ..... *E21B 43/36* (2013.01); *F04B 9/103* (2013.01); *F04B 23/08* (2013.01); *F04B 39/06* (2013.01); *F04B 49/002* (2013.01); *Y10T 137/86155* (2015.04)

(58) Field of Classification Search
USPC ..... 137/535.32
See application file for complete search history.

(56) References Cited

U.S. PATENT DOCUMENTS 4,233,154 A * 11/1980 Presley ..... B01D 17/0214 166/267
4,527,632 A * 7/1985 Chaudot ..... B01D 19/0063 166/357
4,848,471 A * 7/1989 Bencze ..... E21B 43/01 166/335
5,009,680 A * 4/1991 Brekke ..... B01D 45/02 95/247
5,073,090 A 12/1991 Cassidy
5,290,151 A * 3/1994 Orlando ..... F17D 1/005 417/103
5,863,186 A 1/1999 Green et al.
6,162,021 A 12/2000 Sarshar et al.
6,197,095 B1 * 3/2001 Ditria ..... B01D 19/0068 166/267
RE37,603 E * 3/2002 Coney ..... F04B 31/00 417/381
6,907,933 B2 * 6/2005 Choi ..... E21B 43/01 166/265
6,989,103 B2 1/2006 Mohsen et al.
7,686,086 B2 * 3/2010 Brammer ..... E21B 43/40 166/357
7,810,572 B2 * 10/2010 Brandt ..... E21B 43/124 166/105.5
7,854,849 B2 * 12/2010 Wang ..... B01D 17/0214 210/744
8,257,055 B2 9/2012 Beg et al.
8,408,879 B2 * 4/2013 Kidd ..... F04D 17/122 417/84
8,567,183 B2 * 10/2013 Lemofouet ..... F01B 17/025 60/408
8,858,154 B2 10/2014 Guelich
9,032,987 B2 * 5/2015 Bjorge ..... E21B 43/01 137/171
2003/0039554 A1 2/2003 Krasnov
2004/0245182 A1 * 12/2004 Appleford ..... E21B 43/121 210/739
2004/0251030 A1 * 12/2004 Appleford ..... E21B 33/038 166/357
2005/0180864 A1 8/2005 Ursan et al.
2005/0284155 A1 12/2005 Bhatt et al.
2007/0187110 A1 * 8/2007 Lima Goncalves .. E21B 33/035 166/368
2007/0258828 A1 11/2007 Adler et al.
2008/0017594 A1 * 1/2008 Sarshar ..... B01D 17/0217 210/787
2009/0321366 A1 12/2009 Poorte
2010/0006291 A1 * 1/2010 Poorte ..... E21B 43/36 166/302
2011/0232912 A1 * 9/2011 Close ..... E21B 43/01 166/335
2014/0246095 A1 9/2014 Ellis
2014/0377080 A1 12/2014 Xiao et al.
2015/0068741 A1 3/2015 Schultz

OTHER PUBLICATIONS

James D. Van De Ven and Perry Y. Li, "Liquid piston gas compression", Applied Energy, 2009, pp. 1-9, doi: 10.1016/j.apenergy.2008.12.001, Elsevier.

* cited by examiner

MULTIPHASE PRODUCTION BOOST METHOD AND SYSTEM

CROSS REFERENCE TO RELATED APPLICATIONS

This application claims priority to and the benefit of U.S. Provisional Application No. 62/088,749, titled "Multiphase Production Boost Method and System," filed Dec. 8, 2014, the full disclosure of which is hereby incorporated by reference herein in its entirety.

BACKGROUND OF THE DISCLOSURE

1. Field of the Disclosure

The field of disclosure relates to the production of a multiphase hydrocarbon-bearing fluid. More specifically, the field relates to boosting the pressure of the hydrocarbon-bearing fluid with pumps and compressors.

2. Description of the Related Art

Oil and gas production often starts with high reservoir pressure that allows a well to produce oil, gas or a combination of both, naturally. The production fluids are typically mixtures of gas, oil and water. The fraction of gas can increase as the pressure decreases, especially at or near the surface or at other locations where the pressure may drop below bubble point pressure. As the reservoir is produced and the pressure declines, the water cut increases with naturally-driven production, and the production rate drops. This problem of pressure reduction and increase in gas phase can be aggravated if the well is far from a central gathering station and the multiphase fluid is transported over long distances or hilly terrain.

To regain production and increase field recovery, external energy will need to be added to the production systems via either downhole artificial lift or surface pressure boosting. Artificial lift devices need to be able to operate under multiphase flow conditions. Electrical submersible pumps (ESP) are very efficient at handling liquids; however, their performance decreases in the presence of gas.

Multi-phase pumps (MPP) are operable to pump multiphase fluids having a combination of crude oil, water and natural gas without the need for prior separation. With MPP technology, remote separation infrastructure may be eliminated. This leads to lower infrastructure costs associated with the development of hydrocarbon reserves. As well, marginal fields located in hostile environments may also be developed more economically.

Existing MPP technologies include helicon-axial dynamic and twin screw positive displacement types. The helicon-axial multiphase pump includes multiple stages, where each consists of a rotating helico-shaped impeller and a stationary diffuser. This configuration is a hybrid between a dynamic pump and an axial compressor that allows a wide range of liquid flow rates and inlet gas concentration. In theory, a dynamic pump creates pressure dynamically, where shaft torque is converted into angular momentum. The differential pressure depends on motor speed and inlet fluid density. This makes dynamic pumps extremely sensitive to small changes in inlet conditions. Large changes in shaft torque under intermittent flow are common with dynamic pumps. Designs often incorporate flow homogenizers (for example, buffer tanks) to absorb liquid "slugs" and to even out fluctuations in gas density and pressure. This minimizes repetitive torque changes within the pump. In addition, variable speed drive (VFD) is used to adjust the motor speed to maintain a constant inlet pressure.

A twin screw MPP is a rotary positive displacement pump that includes a power shaft and an idle shaft with two screw-shell rotors per shaft. The power shaft is coupled to the motor while the idle shaft is driven by the power shaft through a timing gear on the outboard side of the pump. There are gaps between screw pairs and between the screw and the pump housing to allow abrasive handling. Production fluids enter the pump from both ends. As the screws rotate, fluid fills the volumetric chambers between the individual screw flanks. The thread profile axially transports fluids from both ends of the pump to the center, where the fluids rejoin and exit the pump through the outlet.

SUMMARY OF THE DISCLOSURE

There are issues with using MPP technology. Common issues with the technologies mainly break down along cost, complexity and reliability. Operators typically experience poor uptime and frequent maintenance during initial installation and break-in. The software and control systems for dynamic operations may be inadequate to handle the unstable dynamic behavior of the well, leading to frequent "tripping" and shutdown. The dynamic pumps have a higher-than-average trip frequency compared to all pumps. When restarting after a long shutdown, some installations experienced prolong low speed (500 rpm) operations to handle gas buildup and production fluid having a high gas oil ratio (GOR). This low efficiency production avoids overheating due to prolong gas flow, which has poor heat transfer and lubrication compared to crude oil. System power efficiency using MPP technology is reportedly low with the highest efficiency currently at about 50-60%.

It is desirable to have a system and a method for handling low-pressure multiphase production fluid to produce a high-pressure multiphase fluid where reliability and efficiency are improved over the use of a multi-phase pump system. A reduction in overall operating costs not only in more consistent production but also by using technology that is more reliable and well-known is also viewed as an improvement.

In embodiments of this disclosure, a system for boosting the pressure of a low-pressure multiphase mixture into a high-pressure multiphase mixture is disclosed. A gas-liquid separator of the system has a gas portion and a liquid portion. The gas-liquid separator is operable to separate the low-pressure multiphase mixture into a low-pressure gas and a low-pressure liquid. The system also includes a liquids pump. The liquids pump couples to the liquid portion of the gas-liquid separator. The liquids pump is operable to convert the low-pressure liquid into a high-pressure liquid. The system includes a liquid piston compressor. The liquid piston compressor has a gas portion and a liquid portion. The liquid piston compressor is operable to compress the low-pressure gas into a high-pressure gas using the high-pressure liquid. The gas portion of the liquid piston compressor couples to the gas portion of the gas-liquid separator such that there is one-way fluid communication of the low-pressure gas from the gas-liquid separator to the liquid piston compressor. The liquid portion of the liquid piston compressor couples to the liquids pump such that there is one-way fluid communication of the high-pressure liquid from the liquids pump to the liquid piston compressor.

In alternate embodiments, the liquid portion of the liquid piston compressor can also couple to the liquids pump such that there is one-way fluid communication of a reduced pressure liquid from the liquid piston compressor to the liquids pump. The liquid portion of the liquid piston compressor can alternately couple to the gas-liquid separator such that there is one-way fluid communication of a reduced pressure liquid from the liquid piston compressor to the gas-liquid separator. The system can be operable to maintain the liquid piston compressor in a substantially isothermal condition. The substantially isothermal condition can be maintained using the low-pressure liquid from the gas-liquid separator.

In other alternate embodiments, a liquid level controller can be included that is operable to detect a liquid level within the liquid piston compressor. The liquid level controller can also operable to selectively permit the introduction of the high-pressure liquid into and to selectively permit the passing of a reduced pressure liquid from the liquid piston compressor. The liquid level controller can also be operable to selectively permit the introduction of the low-pressure gas into and to selectively permit the passing of the high-pressure gas from the liquid piston compressor. A temperature controller can alternately be included that is operable to detect a temperature within the liquid piston compressor. The temperature controller can also be operable to selectively permit the introduction of a cooling liquid to the liquid piston compressor.

A method for boosting the pressure of the low-pressure multiphase mixture to the high-pressure multiphase mixture includes introducing the low-pressure multiphase mixture into a pressure boost system. The low-pressure multiphase mixture comprises the low-pressure liquid and the low-pressure gas. The method includes operating the pressure boost system such that the low-pressure liquid and the low-pressure gas form from the low-pressure multiphase mixture, and a high-pressure liquid forms from the low-pressure liquid. During a charging period the low-pressure gas is introduced into, and the low-pressure liquid passes from, a liquid piston compressor. During a compression period the high-pressure liquid is introduced into the liquid piston compressor such that the low-pressure gas converts into a high-pressure gas. During a discharging period the high-pressure liquid is introduced into, and the high-pressure gas passes from, the liquid piston compressor. The high-pressure liquid and the high-pressure gas are mixed such that the high-pressure multiphase mixture forms. The method includes passing the high-pressure multiphase mixture from the pressure boost system.

In alternate embodiments, a pressure difference between the high-pressure liquid and the high-pressure gas is not substantial. The pressure boost system can be operated such that the liquid piston compressor during the compression period is maintained at a substantially isothermal condition. The compression period can start at the detection of a low liquid level and end at the detection of a high level liquid level within the liquid piston compressor. The charging period can start at the detection of a high liquid level and end at the detection of a low level liquid level within the liquid piston compressor. During the compression period, a cooling liquid can be introduced to the liquid piston compressor. During both the compression and discharge periods a cooling liquid can be introduced to the liquid piston compressor such that the liquid piston compressor is maintained at a substantially isothermal condition. The pressure boost system can comprise more than one liquid piston compressor and when a first liquid piston compressor is operating in a charging period, a second liquid piston compressor can be operating in a discharging period.

The methods and the systems disclosed herein are for boosting production of a multi-phase fluid comprising crude oil, natural gas and formation water. The systems separate the gas-liquid mixture into a low-pressure gas and a low-pressure liquid. A conventional-type liquid pump is used to increase the pressure of the liquid, which is a combination of crude oil and formation water, to a high-pressure liquid. The gas pressure is boosted using a liquid piston compressor, where the liquid driving the liquid piston compressor is the high-pressure liquid. The high-pressure gas and the high-pressure liquid are recombined into a multi-phase product and passed from the system. Optionally, the liquid piston compressor is operable to cool such that isothermal or near-isothermal compression occurs. The systems offer compactness, higher reliability and higher energy efficiency with well-understood and reliable components.

The systems offer a solution by permitting the use of known separators and standard liquid pumps to handle a multiphase production. The low-pressure gas is separated before the intake of the liquids pump and it is reintroduced after the high-pressure liquid discharges. The low-pressure gas is compressed using the liquid piston compressor that optionally may operate under near-isothermal to isothermal gas conditions to achieve a high power efficiency. Liquid piston compression overcomes the poor heat transfer issue associated with typical mechanical compressions such as reciprocating piston compressors, and the lack of moving mechanical parts adds reliability to the operating system.

The disclosed methods and systems are useful for wet gas compression, and for off-shore and subsea and downhole applications.

BRIEF DESCRIPTION OF THE DRAWINGS

These and other features, aspects, and advantages of the present disclosure are better understood with regard to the following Detailed Description of the Preferred Embodiments, appended Claims, and accompanying Figures, where:

FIG. 1-3 shows an embodiment of the method of use and a system for boosting pressure of a multiphase fluid. FIG. 1-3 and its description facilitate a better understanding of the boosting pressure system and its method of use. In no way should FIGS. 1-3 limit or define the scope of the embodiments of this disclosure. FIG. 1-3 are a simple diagram for ease of description.

Figure 1:
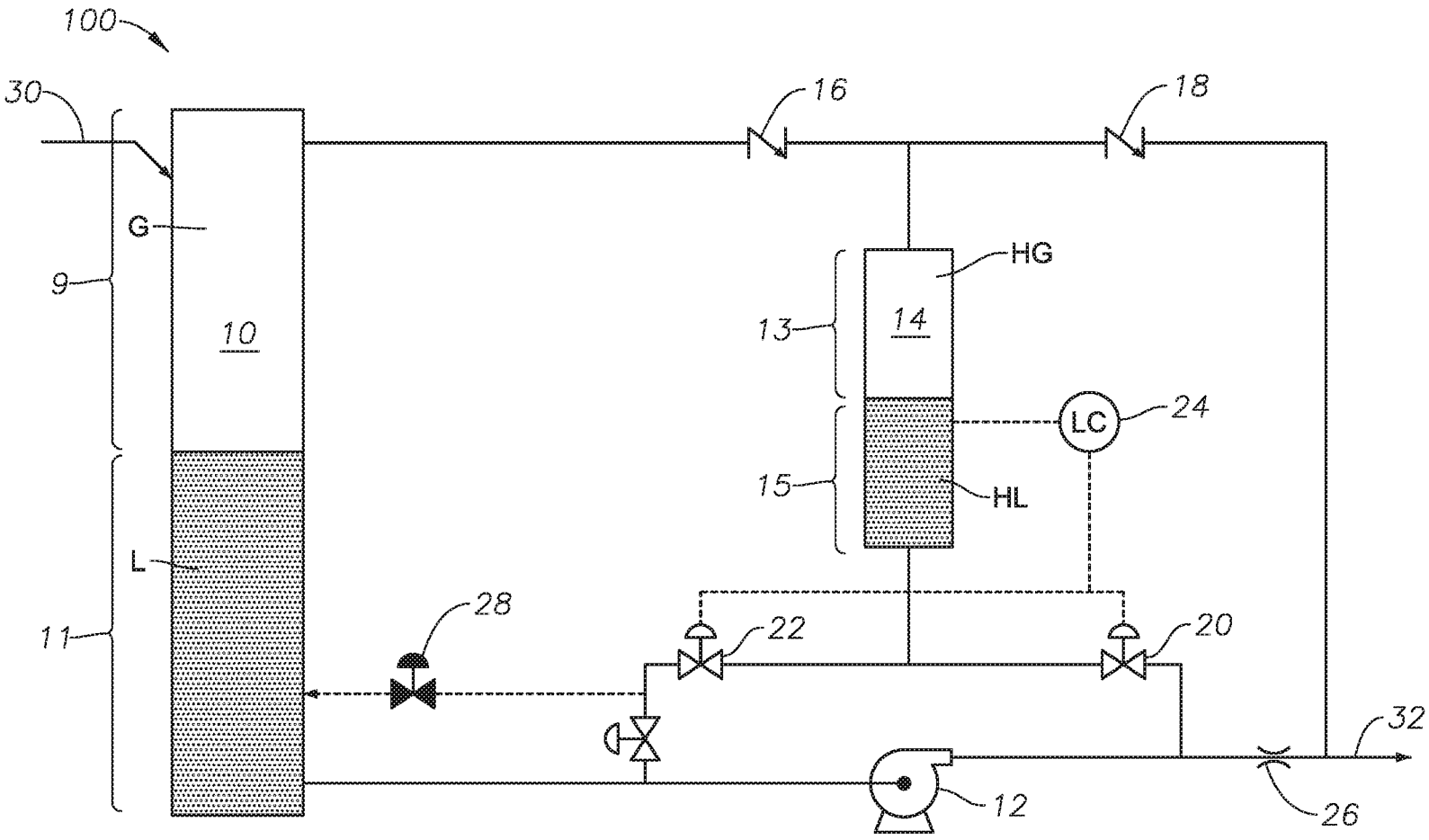
FIG. 1 shows a schematic diagram of an embodiment of the production boost system for performing the production boost method.

In the accompanying Figures, similar components or features, or both, may have a similar reference label. Further, various components of the same type may be distinguished by following the reference label with a secondary label or mark of distinction, including a "'" or an alphanumeric character.

DETAILED DESCRIPTION OF THE PREFERRED EMBODIMENTS

The Specification, which includes the Summary of Disclosure, Brief Description of the Drawings and the Detailed Description of the Preferred Embodiments, and the appended Claims refer to particular features (including process or method steps) of the embodiments of this disclosure. Those of skill in the art understand that the embodiments of this disclosure include all possible combinations and uses of particular features described in the Specification. Those of skill in the art understand that the disclosure is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this disclosure belongs unless defined otherwise.

As used in the Specification and appended Claims, the singular forms "a", "an" and "the" include plural references unless the context clearly indicates otherwise. The verb "comprises" and its conjugated forms should be interpreted as referring to elements, components or steps in a non-exclusive manner, and the illustrative embodiments disclosed suitably may be practiced in the absence of any element which is not specifically disclosed, including as "consisting essentially of" and "consisting of". The referenced elements, components or steps may be present, utilized or combined with other elements, components or steps not expressly referenced. The verb "couple" and its conjugated forms means to complete any type of required junction, including electrical, mechanical or fluid, to form a singular object from two or more previously non-joined objects. If a first device couples to a second device, the connection can occur either directly or through a common connector. "Optionally" and its various forms means that the subsequently described event or circumstance may or may not occur. The description includes instances where the event or circumstance occurs and instances where it does not occur. "Operable" and its various forms means fit for its proper functioning and able to be used for its intended use. "Associated" and its various forms means something connected with something else because they occur together or that one produces the other. "Detect" and its conjugated forms should be interpreted to mean the identification of the presence or existence of a characteristic or property. "Determine" and its conjugated forms should be interpreted to mean the ascertainment or establishment through analysis or calculation of a characteristic or property Spatial terms describe the relative position of an object or a group of objects relative to another object or group of objects. The spatial relationships apply along vertical and horizontal axes. Orientation and relational words, including "uphole" and "downhole", are for descriptive convenience and are not limiting unless otherwise indicated. "Substantial" means equal to or greater than 10% by the indicated unit of measure. "Significant" means equal to or greater than 1% by the indicated unit of measure.

Where the Specification or the appended Claims provide a range of values, it is understood that the interval encompasses each intervening value between the upper limit and the lower limit as well as the upper limit and the lower limit. The disclosure encompasses and bounds smaller ranges of the interval subject to any specific exclusion provided.

Where the Specification and appended Claims reference a method comprising two or more defined steps, the defined steps can be carried out in any order or simultaneously except where the context excludes that possibility.

FIG. 1

FIG. 1 shows a schematic diagram of an embodiment of the production boost system for performing the production boost method. Production boost system 100 includes gas-liquid separator 10, liquids pump 12, liquid piston compressor 14, low-pressure gas inlet valve 16, high-pressure gas outlet valve 18, high-pressure liquid supply valve 20, liquid recycle valve 22, liquid level controller 24 and liquid orifice plate 26 are coupled together such that low-pressure gases and low-pressure liquids are pressurized into high-pressure liquids and gases. Production boost system 100 is operable to receive a low-pressure gas, oil, and water multiphase mixture that is introduced through introduction line 30 and to pass as a product that is a high-pressure gas, oil, and water mixture through production line 32.

As an example, when the low-pressure multiphase mixture is introduced into the production boost system, the low-pressure multiphase mixture can have a pressure in a range from atmospheric pressure to up to 1000 psig, and can have a temperature in a range from 40-200 degrees Fahrenheit. If the low-pressure multiphase mixture is from an oil production system, the gas-liquid ratio can be, as an example, 50-900 SCF/STB. If the low-pressure multiphase mixture is from a gas condensate system, the condensate gas ratio can be, for example, 50-350 BBL/MMSCF and the water gas ratio can be, for example, 2-10 BBL/MMSCF. The low-pressure multiphase mixture can have, as an example, a water cut of 0-80%.

Low-pressure gas G is located in gas portion 9 and lower pressure liquid L is located in liquid portion 11 of gas-liquid separator 10. The multiphase mixture introduced through introduction line 30 separates into low-pressure gas G and low-pressure liquid L, where the low-pressure liquid L includes both crude oil or condensates as well as water or brine. Gas-liquid separator 10 may be any type of separator mechanism that is operable to separate vapors and gases from liquids, including horizontal or vertical gravity separators, which include heated, cooled, atmospheric and vacuum distillation towers and packed columns; cyclone separators; and inline separators.

Liquids pump 12 couples with liquid portion 11 of gas-liquid separator 10 such that at least a portion of the liquid intake into liquids pump 12 is from gas-liquid separator 10. Liquids pump 12 may be any type of conventional liquid conveying mechanism that imparts greater force or pressure into the liquid that it discharges than the liquid that it draws inward, including centrifugal pumps and displacement pumps. Liquids pump 12 is not a multiphase pump (both gas and liquid simultaneously); rather, liquids pump 12 is a standard liquid-conveying pump, which improves its reliability and reduces both its operational and replacement costs. When high-pressure liquid HL is discharged from liquids pump 12, high-pressure liquid HL can have a pressure, as an example, in a range of 300-1200 psig.

Low-pressure gas inlet valve 16 is located between and is operable to permit low pressure gas G to pass in one-way communication from gas-liquid separator 10 to gas portion 13 of liquid piston compressor 14. Low-pressure gas inlet valve 16 is also operable to deny high-pressure gas HG from passing from liquid piston compressor 14 to gas-liquid separator 10. The check valve for low-pressure gas inlet valve 16 has a spring tension (low-pressure differential tension setting) as part of its valve flapper mechanism such that low-pressure gas from gas-liquid separator 10 is permitted to flow towards liquid piston compressor 14 when a sufficient differential pressure exists between gas-liquid separator 10 and liquid piston compressor 14. The low pressure differential tension setting is such that gas communication from liquid piston compressor 14 to gas-liquid separator 10 does not occur: the low-pressure differential tension setting is not overcome by a switch in flow direction. High-pressure gas outlet valve 18 operates in a similar manner: it has a high-pressure differential tension setting that permits high pressure gas HG to pass from gas portion 13 of liquid piston compressor 14 in one-way communication towards production line 32 when a sufficient pressure differential exists. High-pressure gas outlet valve 18 is also operable to deny gas having insufficient pressure from passing towards production line 32.

In the embodiment of the system shown in FIG. 1, low-pressure gas inlet valve 16 and high-pressure gas outlet valve 18 are both check valves. In another embodiment of the system, either or both check valves are replaced with a control valve. In such an embodiment, the control valve is operated such that no backflow of gas to either gas-liquid separator 10 or liquid piston compressor 14, respectively, occurs. The types of control valves for either or both low-pressure gas inlet valve 16 and high-pressure gas outlet valve 18 includes ball, plug, gate and globe valves. The valve actuators for such control valves can be electric or pneumatic. In such an embodiment, a pressure controller monitors the gas pressures associated with gas upstream of the control valve low-pressure gas inlet valve 16, between the control valve of low-pressure gas inlet valve 16 and high-pressure gas outlet valve 18 and downstream of the control valve of high-pressure gas outlet valve 18 such that production boost system 100 is operable to open and close the control valve of low-pressure gas inlet valve 16 and high-pressure gas outlet valve 18 during the appropriate periods of performing an embodiment of the production boost method.

In another embodiment of the system, low-pressure gas inlet valve 16 and high-pressure gas outlet valve 18 are substituted for a 3-way valve that is operable to switch position depending on the gas operation associated with liquid piston compressor 14 (filling, letting down).

In an embodiment of the system, the liquid portion of the liquid piston compressor 14 also couples to the liquids pump 12 such that there is one-way fluid communication of a reduced pressure liquid from the liquid piston compressor 14 to the liquids pump 12. The reduced pressure liquid may pass to liquids pump 12, gas-liquid separator 10 or both depending on production boost system 100 operations. Fluids will generally travel from areas of higher pressure towards areas of lower pressure. The reduced pressure liquid can have a lower pressure than the low-pressure gas, and the movement of reduced pressure liquid out of the liquid piston compressor can cause a pressure sink within the liquid piston compressor 14, both of which can help pull the low-pressure gas into liquid piston compressor 14, helping with the charging period. Depending on the number and size of the liquid piston compressors 14 and the gas-liquid ratio, it can take a number of minutes to perform each of the charging periods and the compression periods.

Liquid recycle valve 22 is located between and is operable to selectively permit reduced pressure liquid to pass from liquid piston compressor 14 during the charging period. The reduced pressure liquid passes in one-way communication from liquid portion 15 of liquid piston compressor 14. The reduced pressure liquid is not high-pressure liquid HL because during the charging period the gas introduced into liquid piston compressor 14 is low-pressure gas G, which helps to force reduced pressure liquid from liquid piston compressor 14. Liquid recycle valve 22 is also operable to deny the low-pressure liquid L from bypassing liquids pump 12 and entering liquid piston compressor 14 directly from gas-liquid separator 10.

In another embodiment of the system, the liquid portion of the liquid piston compressor couples to the gas-liquid separator such that there is one-way fluid communication of the reduced pressure liquid from the liquid piston compressor to the gas-liquid separator. During cycling of liquid piston compressor 14, gas may become entrained or dissolve into the liquid within liquid piston compressor 14. Any gases recycled to the fluid inlet line for liquids pump 12 may come out of solution and form bubbles, which causes cavitation. Cavitation over time will break down liquids pump 12 impeller and erode the pump housing. To avoid gas entrainment in the fluid inlet line for liquids pump 12, the reduced pressure liquid passing from liquid recycle valve 22 optionally is directed back to gas-liquid separator 10 through recycle valve 28 line. Recycling reduced pressure liquid back to gas-liquid separator 10 allows the reduced pressure liquid to release any entrained gases in gas-liquid separator 10 instead of in the low pressure conditions at the inlet draw of liquids pump 12.

High-pressure liquid supply valve 20 is located between and is operable to permit high-pressure liquid HL to pass in one-way communication from liquids pump 12 to liquid portion 15 of liquid piston compressor 14. For low gas to oil ratio systems, the amount of high-pressure liquid passing from liquids pump 12 to liquid portion 15 of liquid piston compressor 14 can be as low as 10%. For higher gas to oil ratio systems, the amount of high-pressure liquid passing from liquids pump 12 to liquid portion 15 of liquid piston compressor 14 can be as high as 90%. High-pressure liquid supply valve 20 is also operable to deny low-pressure liquid L from bypassing liquids pump 12 and into production line 32.

High-pressure liquid supply valve 20 and liquid recycle valve 22 may include various types of valves: ball, plug, gate and globe. The valve actuators can be electric or pneumatic.

In another embodiment of the system, high-pressure liquid supply valve 20 and liquid recycle valve 22 are substituted for a 3-way valve that is operable to switch position depending on the liquid operation associated with liquid piston compressor 14 (filling, letting down).

Gas, especially high-pressure gas HG is located in gas portion 13 and liquid, especially high-pressure liquid HL, is located in liquid portion 15 of liquid piston compressor 14. Gas portion 13 couples with gas portion 9 through low-pressure gas inlet valve 16 and production line 32 through high-pressure gas outlet valve 18. Liquid portion 15 couples with liquid portion 11 through liquids pump 12 and high-pressure liquid supply valve 20, and with production line 32 through liquids pump 12 and liquid recycle valve 22.

In an embodiment of the system, the production boost system includes a liquid level controller that is operable to detect a liquid level within the liquid piston compressor. Production boost system 100 includes liquid level controller 24 that is signally coupled to several portions of liquid piston compressor 14 for monitoring the liquid level conditions during cycling of liquid piston compressor 14.

Liquid level set points for liquid piston compressor 14 may maximize the use of liquid piston compressor 14 volumetric capacity while also preventing liquid overflow (excessive liquid) or gas blow through (insufficient liquid). Maximizing volumetric capacity between the low set point and the high set point maximizes system efficiency for each stroke (charging, compressing, and discharging) of liquid piston compressor 14. In an embodiment of the system, a high level set point for liquid level controller 24 is 90% of the volumetric capacity of liquid piston compressor 14 and a low level set point is 10% of the volumetric capacity of liquid piston compressor 14.

Liquid level controller 24 is in signal communication with both high-pressure liquid supply valve 20 and liquid recycle valve 22. Liquid level controller 24 is operable to modify the position of each valve. In an embodiment of the system, the liquid level controller is also operable to selectively permit the introduction of the high-pressure liquid into and to selectively permit the passing of a reduced pressure liquid from the liquid piston compressor. In an embodiment of the method, the production boost system changes from charging the liquid piston compressor with low-pressure gas during the charging period, to compressing the charged gas upon detection by the level controller of a liquid level at the low level set point during the compression period. In an embodiment of the method, the production boost system changes from discharging the high-pressure gas to charging the liquid piston compressor with low-pressure gas upon detection by the level controller of a liquid level at the high level set point.

In an embodiment of the system, liquid level controller 24 is also in signal communication with both low-pressure gas inlet valve 16 and high-pressure gas outlet valve 18. In such an embodiment, the liquid level controller is also operable to selectively permit the introduction of the low-pressure gas into and to selectively permit the passing of the high-pressure gas from the liquid piston compressor. In an embodiment of the system, the compression of charged gas is an isothermal or near-isothermal process, where the temperature of the gas remains constant. Extra cooling may be required to achieve such an isothermal compression. In other alternate embodiments, the compression of charged gas is not an isothermal or near-isothermal process and no extra cooling is required during the compression period.

To re-comingle the higher-pressure liquid and gas, the pressures of the liquid and the gas are similar. The high-pressure liquid has a higher pressure than the high-pressure gas during mixing into the high-pressure multiphase mixture. In an embodiment of the method, the pressure difference between the high-pressure liquid and the high-pressure gas is not substantial. A pressure reduction device, including liquid orifice plate 26, provides physical resistance to the liquid, which results in a pressure drop across the liquid orifice plate 26. Reducing the liquid pressure allows both the high-pressure liquid and high pressure gas to be at similar values, permitting them to be comingled and recombined into the produced higher-pressure multi-phase fluid.

FIGS. 2A-C

Figure 2A:
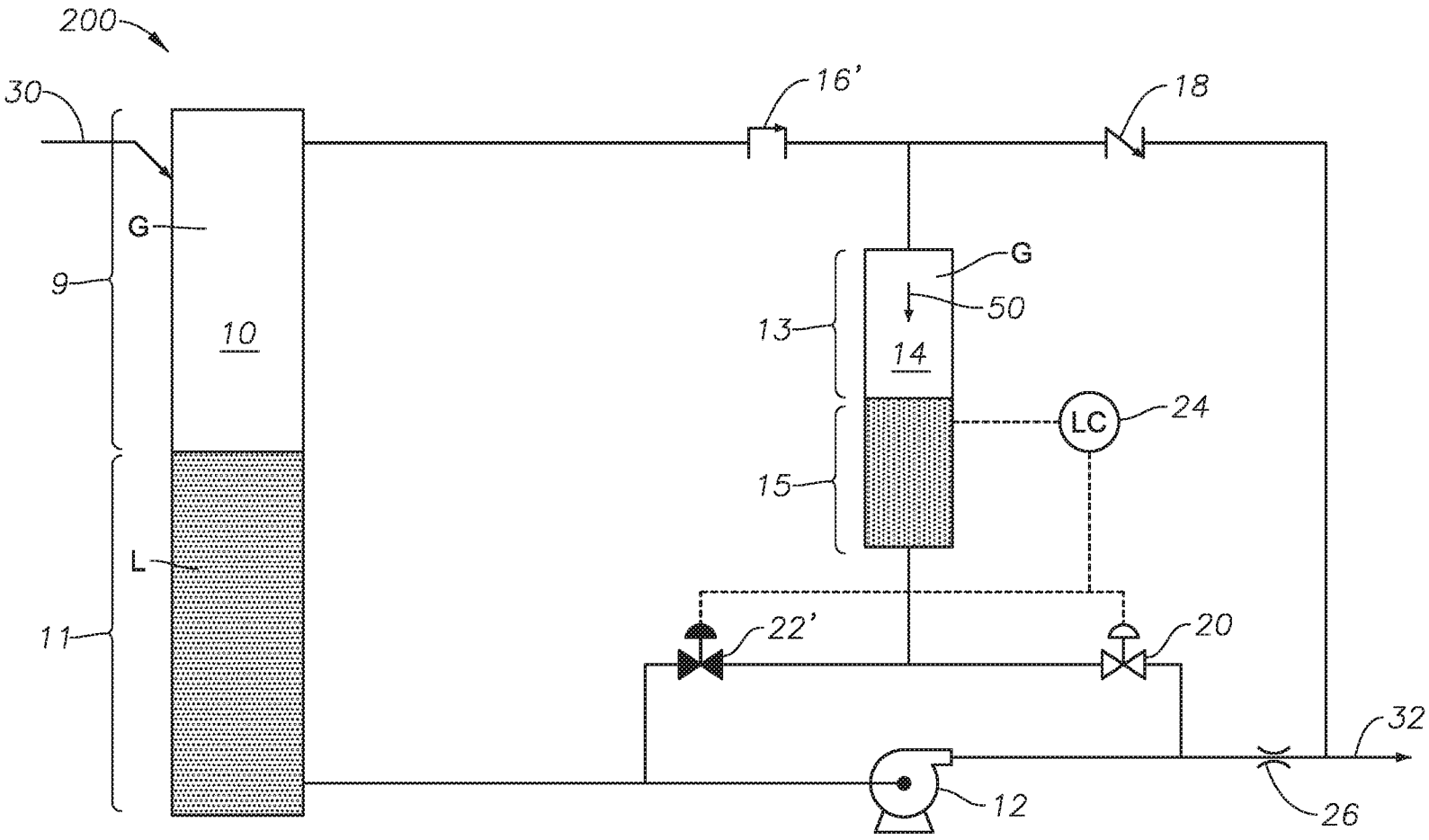
FIGS. 2A-C show a schematic diagram of an embodiment of the production boost system performing an embodiment of the production boost method.
Figure 2B:
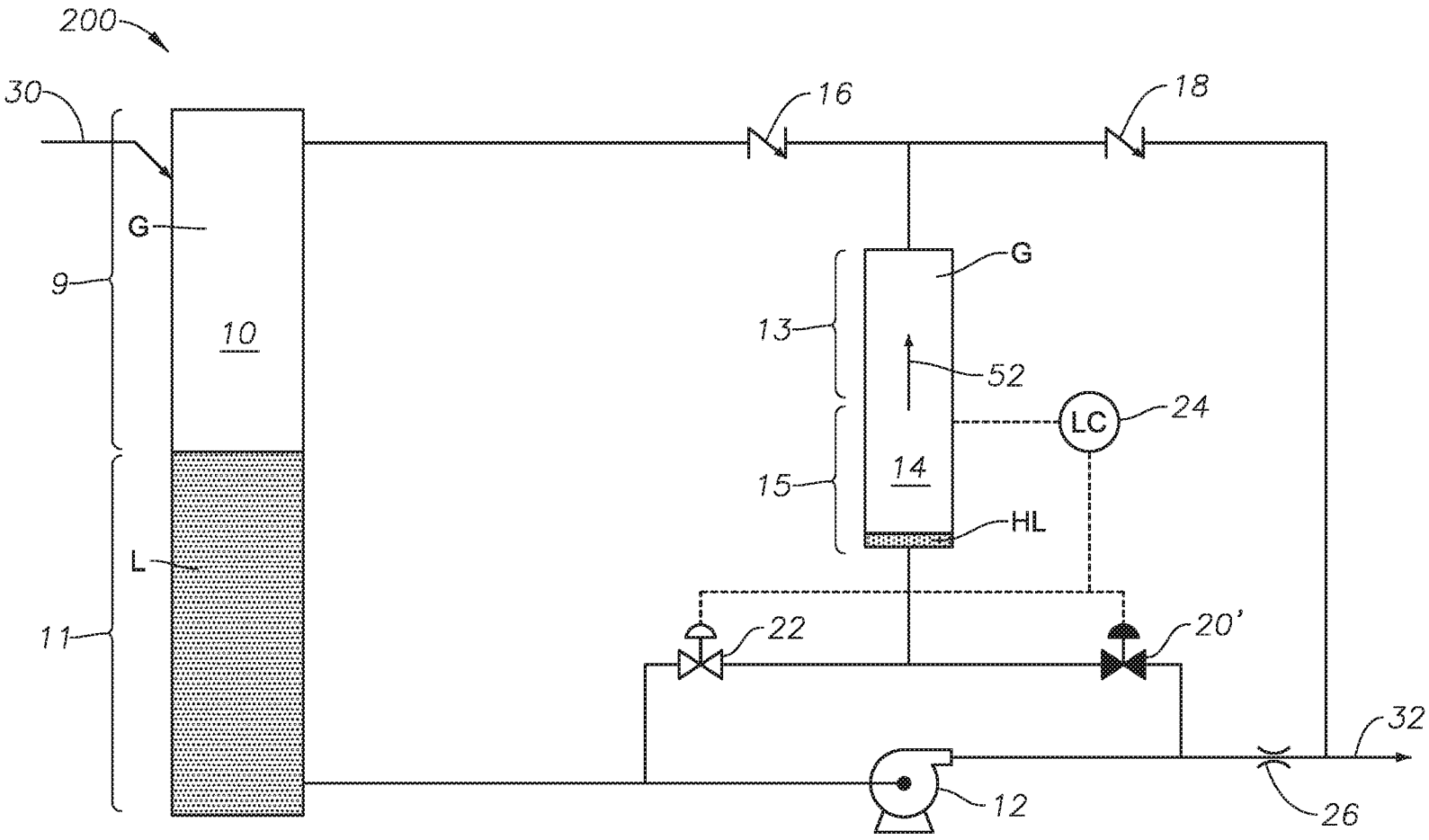
Figure 2C:
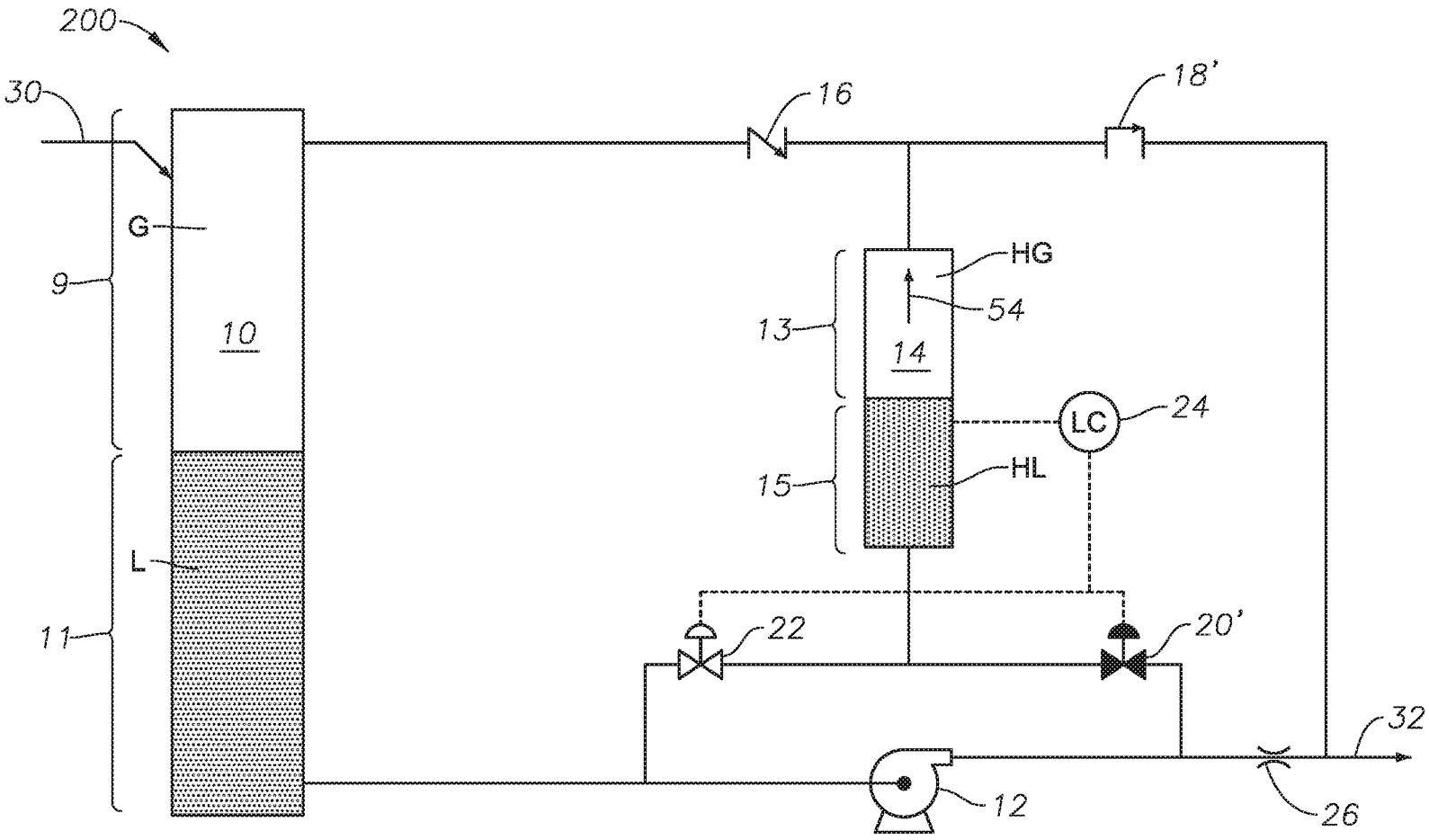

FIGS. 2A-C show a schematic diagram of an embodiment of the production boost system performing an embodiment of the production boost method. Production boost system 200 is similar in configuration to production boost system 100 except for the lack of recycle valve 28 line, which is omitted for the sake of clarity of discussing the steps of the production boost method.

The low-pressure gas, oil, and water multiphase mixture is continually introduced through introduction line 30 into production boost system 200. Production boost system 200 operates gas-liquid separator 10 such that the low-pressure gas, oil, and water multiphase mixture separates into low-pressure liquid L and low-pressure gas G. Production boost system 200 operates liquids pump 12 such that it conveys low-pressure liquid L from gas-liquid separator 10 and converts it into high-pressure liquid HL. Production boost system 200 operates liquid piston compressor 14 using high-pressure liquid HL to compresses low-pressure gas G into high-pressure gas HG. Production boost system 200 combines high-pressure liquid HL and high-pressure gas HG and passes the product high-pressure gas, oil and water multiphase mixture through production line 32.

During a charging period, production boost system 200 introduces low-pressure gas G into liquid piston compressor 14. FIG. 2A shows low-pressure gas G being introduced into liquid piston compressor 14. In an embodiment of the method, the charging period starts at the detection of a high liquid level and ends at the detection of a low level liquid level within the liquid piston compressor. During the charging period, liquid recycle valve 22 operates and transitions into open liquid recycle valve 22' (black), forming a liquid fluid pathway between liquid piston compressor 14 and the suction line for liquids pump 12. The operation of liquids pump 12 provides a pressure drive for reduced pressure liquid in liquid piston compressor 14 to move towards liquids pump 12 and vacate liquid piston compressor 14 (arrow 50). The one-way pressure differential between gas-liquid separator 10 and liquid piston compressor 14 is sufficient to permit low-pressure gas inlet valve 16 to operate (overcoming its low-pressure gas differential tension setting) and transition into open low-pressure gas inlet valve 16' (open). Open low-pressure gas inlet valve 16' permits low-pressure gas G to flow from gas-liquid separator 10 into liquid piston compressor 14.

During a compression period, production boost system 200 introduces high-pressure liquid HL into liquid piston compressor 14 while maintaining the previously introduce gas in a fixed volume. In an embodiment of the method, the compression period starts at the detection of a low liquid level and ends at the detection of a high level liquid level within the liquid piston compressor. In an embodiment of the method, a cooling liquid is introduced to the liquid piston compressor during the compression period. FIG. 2B shows production boost system 200 operating such that high-pressure liquid HL compresses low-pressure gas G such that high-pressure gas HG forms. High-pressure liquid supply valve 20 operates and transitions into open high-pressure liquid supply valve 20' (black), forming a liquid fluid pathway between liquid piston compressor 14 and the discharge line for liquids pump 12. Also, open liquid recycle valve 22' operates and transitions into liquid recycle valve 22 (white), closing the previously opened pathway between liquid piston compressor 14 and the suction line for liquids pump 12. This combination of control valve operations provides a pressure drive for high-pressure liquid HL to move from liquids pump 12 into liquid piston compressor 14. Open low-pressure gas inlet valve 16' operates and transitions into low-pressure gas inlet valve 16 (closed), isolating the previously introduced low-pressure gas G between low-pressure gas inlet valve 16, high-pressure gas outlet valve 18, and high-pressure liquid HL in liquid piston compressor 14. Low-pressure gas inlet valve 16 closes due to the one-way pressure differential between gas-liquid separator 10 and liquid piston compressor 14 not being sufficient to overcome the low-pressure gas differential tension setting of the low-pressure gas inlet valve 16. The movement of high-pressure liquid HL against low-pressure gas G in liquid piston compressor 14 drives the fluid level in liquid piston compressor 14 upwards (arrow 52).

Upon liquid level controller 24 detecting a low liquid level condition within liquid piston compressor 14, production boost system 200 operates high-pressure liquid supply valve 20 such that high-pressure liquid HL is introduced into liquid piston compressor 14. In addition, production boost system 200 optionally operates low-pressure gas inlet valve 16 such that low-pressure gas G is no longer introduced into liquid piston compressor 14. Low-pressure gas G is compressed into high-pressure gas HG as previously provided for in the description of FIG. 2B.

During a discharge period, production boost system 200 passes high-pressure gas HG from liquid piston compressor 14. FIG. 2C shows high-pressure gas HG formed in liquid piston compressor 14 and production boost system 200 operating such that high-pressure gas HG discharges towards production line 32. The pressure of high-pressure gas HG in liquid piston compressor 14 is sufficient to overcome the high-pressure gas differential tension setting of high-pressure gas outlet valve 18. High-pressure gas outlet valve 18 operates and transitions into open high-pressure gas outlet valve 18' (open), permitting high-pressure gas HG to flow from liquid piston compressor 14 as the high-pressure liquid HL level continues to elevate (arrow 54). Open high-pressure liquid supply valve 20' remains open to provide drive against high-pressure gas HG during discharge.

In an embodiment of the method, during both the compression and discharge periods a cooling liquid is introduced to the liquid piston compressor such that the liquid piston compressor is maintained at a substantially isothermal condition.

Upon liquid level controller 24 detecting a high liquid level condition within liquid piston compressor 14, production boost system 200 operates open high-pressure liquid supply valve 20' such that high-pressure liquid HL is no longer introduced into liquid piston compressor 14 by closing the valve. In addition, production boost system 200 optionally operates liquid recycle valve 22 such that a reduced pressure liquid passes from liquid piston compressor 14. The production boost system 200 operates open high-pressure gas outlet valve 18' such that it closes into high-pressure gas outlet valve 18. High-pressure gas outlet valve 18 prevents the passing of high-pressure gas HG towards production line 32. In a further embodiment of the method, production boost system 200 operates such that low-pressure gas G charges liquid piston compressor 14 as previously provided in the description of FIG. 2A.

In operation, the gas charging, compression, and discharging steps outline a cyclical, repeating process for operating production boost system. An embodiment of the production boost system includes more than one liquid piston compressor. In an embodiment of the method, the pressure boost system comprises more than one liquid piston compressor and while a first liquid piston compressor operates in a charging period a second liquid piston compressor operates in a discharging period. Operating such a system having several liquid piston compressors in parallel and in staggered operation (one charging, one compressing, one discharging simultaneously) may reduce disruption of the operation from a centralized liquid-gas separator, liquids pump and product discharge line. Several liquid piston compressors acting in parallel may also prevent downstream slugging from cyclical discharging operations. Such a system maintains a uniform flow of high-pressure gas for forming the production multiphase mixture.

FIG. 3

Figure 3:
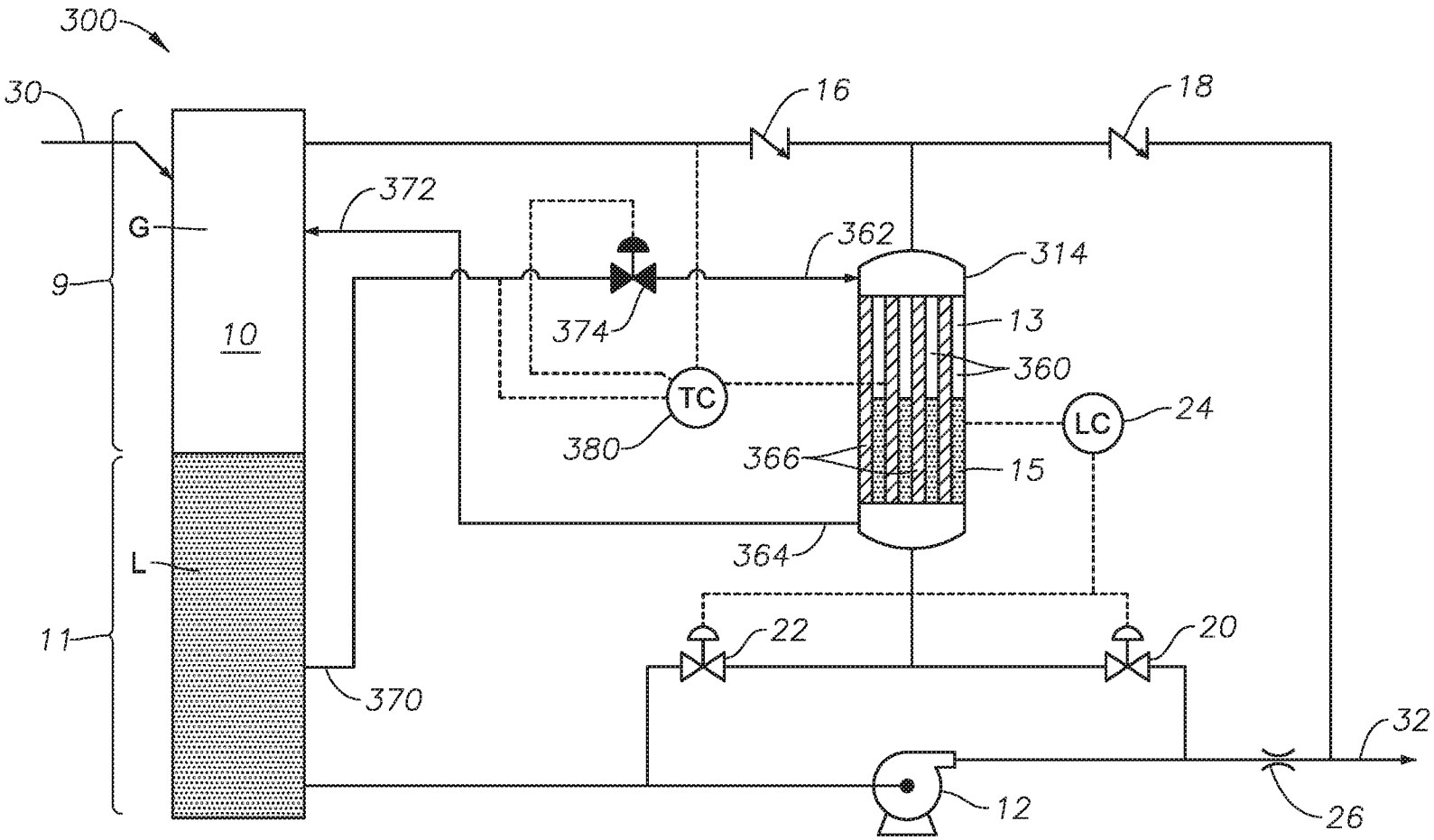
FIG. 3 shows a schematic diagram of another embodiment of the production boost system for performing the production boost method.

FIG. 3 shows a schematic diagram of another embodiment of the production boost system for performing the production boost method. Production boost system 300 is of a similar configuration as production boost system 100 shown in FIG. 1 and production boost system 200 shown in FIGS. 2A-C; however, liquid piston compressor 14 is replaced with isothermal liquid piston compressor 314. Production boost system 300 also includes cooling liquid feed line 370, liquid return line 372, flow control valve 374 and temperature controller 380. In an embodiment of the system, the production boost system is operable to maintain the liquid piston compressor in a substantially isothermal condition. In an embodiment of the system, the production boost system is operable to maintain the liquid piston compressor in a significantly isothermal condition. In an embodiment of the system, the production boost system is operable to maintain the liquid piston compressor in an isothermal condition.

Production boost system 300 includes isothermal liquid piston compressor 314. As low-pressure gas G is compressed during the compression period within the volume bound by low-pressure gas inlet valve 16, high-pressure gas outlet valve 18 and isothermal liquid piston compressor 314, without some sort of cooling the temperature of the compressing gas will increase. A temperature increase in the gas represents a loss of energy-energy that could have been transformed into higher pressure. To improve system efficiency in compressing the low-pressure gas to the high-pressure gas, production boost system 300 is operable to use low-pressure liquid L to make the conditions for the compressing gas within isothermal liquid piston compressor 314 as isothermal or as close to isothermal as feasible. In an embodiment of the system, the substantially isothermal condition is maintained using the low-pressure liquid from the gas-liquid separator.

For production boost system 300, isothermal liquid piston compressor 314 is akin to a single pass "tube and shell" heat exchanger. The "tube" portion of liquid piston compressor 314 acts as several liquid piston compressors 360 operating in parallel similar to liquid piston compressor 14 of FIGS. 1-2C. In an embodiment of the system, the exterior surface of several liquid piston compressors 360 includes radiative fins that are operable to distribute heat into a liquid within shell fluid void 366.

The "shell" side includes inlet head 362, outlet head 364 and shell fluid void 366. Inlet head 362, outlet head 364 and shell fluid void 366 are coupled such that liquid fluid flows through each without restriction. Shell fluid void 366 is defined as the void volume inside the exterior shell of isothermal liquid piston compressor 314 and is bound by the exteriors of several liquid piston compressors 360, inlet head 362 and outlet head 364. In an embodiment of the system, shell fluid void 366 may be further divided by internal baffles to enhance the liquid fluid contact with the exterior surface of several liquid piston compressors 360. Inlet head 362, outlet head 364 and shell fluid void 366 are operable to receive low-pressure liquid L upstream of liquids pump 12, high-pressure liquid HL downstream from liquids pump 12 or a combination of both. Shell fluid void 366 is operable to permit concurrent or counter-current liquid flow.

FIG. 3 shows isothermal liquid piston compressor 314 coupled to gas-liquid separator 10 through the shell side by cooling liquid feed line 370 and liquid return line 372. Cooling liquid feed line 370 permits low-pressure liquid L feed from gas-liquid separator 10 to the shell side of isothermal liquid piston compressor 314. Cooling liquid feed line 370 includes flow control valve 374, which is operable to regulate the amount of low-pressure liquid passing into inlet head 362 of isothermal liquid piston compressor 314. Liquid return line 372 permits returning low-pressure liquid L, which has a higher temperature than low-pressure liquid L in cooling liquid feed line 370 after thermal exchange within isothermal liquid piston compressor 314, to flow from outlet head 364 back to gas-liquid separator 10. Introducing the higher-temperature low-pressure liquid L back into gas-liquid separator 10 has the additional benefit of introducing heat into gas-liquid separator 10, which drives the liquid and gas separation further.

The flow direction within the shell for production boost system 300 is "counter-current" in the sense that the low-pressure liquid L is introduced in an opposing flow direction (as shown in FIG. 3 from top down) than the fluid and gas compression direction (as shown in FIGS. 1-3 as bottom up) across several liquid piston compressor 360 tubes. The counter-current flow allows cooler low-pressure liquid L to contact the exterior of several liquid piston compressors 360 first, producing a greater temperature differential between the compressing gas within several liquid piston compressors 360 and the low-pressure liquid in shell fluid void 366.

Production boost system 300 includes temperature controller 380 that is signally coupled to several portions of production boost system 300 for monitoring temperature conditions. In an embodiment of the system, production boost system includes a temperature controller that is operable to detect a temperature within the liquid piston compressor. Temperature controller 380 is in signal communication with several temperature probes and is operable to detect the temperatures of low-pressure gas G upstream of low-pressure gas inlet valve 16, compressing gas within several liquid piston compressors 360 and cooling liquid feed upstream of flow control valve 374. In an embodiment of the system, the temperature controller is also operable to selectively permit the introduction of a cooling liquid to the liquid piston compressor. Temperature controller 380 is in signal communication with flow control valve 374 and is operable to modify its position to achieve the appropriate cooling liquid feed flow.

Temperature controller 380 is operable to regulate the fluid flow rate of cooling liquid feed through shell fluid void 366 during the compression step such that an isothermal or as close to isothermal condition as feasible within several liquid piston compressors 360 occurs. In an embodiment of the method, the pressure boost system is operated such that the liquid piston compressor during the compression period is maintained in a substantially isothermal condition. In an embodiment of the method, the pressure boost system is operated such that the liquid piston compressor during the compression period is maintained in a significantly isothermal condition. In an embodiment of the method, the pressure boost system is operated such that the liquid piston compressor during the compression period is maintained in an isothermal condition.

What is claimed is:

1. A system for boosting a pressure of a low-pressure multiphase mixture into a high-pressure multiphase mixture, the system comprising:

a gas-liquid separator having a gas portion and a liquid portion and that is operable to separate the low-pressure multiphase mixture into a low-pressure gas and a low-pressure liquid;

a liquids pump that couples to the liquid portion of the gas-liquid separator and that is operable to convert the low-pressure liquid into a high-pressure liquid; and a liquid piston compressor having a gas portion and a liquid portion and that is operable to compress the low-pressure gas into a high-pressure gas using the high-pressure liquid;

an inlet head at a first end of the liquid piston compressor, an outlet head at an opposite end of the liquid piston compressor, and a shell fluid void located within a shell between the inlet head and the outlet head and within the liquid piston compressor, where the inlet head is in fluid communication with the liquid portion of the gas-liquid separator by way of a cooling liquid feed line and the outlet head is in direct fluid communication with the gas-liquid separator by way of a return line, so that the low-pressure liquid passes through the cooling liquid feed line and returns to the gas-liquid separator to mix with the low-pressure multiphase mixture being introduced into the pressure boost system; where the liquid piston compressor includes a plurality of liquid piston compressor tubes located within the shell, the plurality of liquid piston compressor tubes operable to operate in parallel to compress the low-pressure gas into the high-pressure gas;

the gas portion of the liquid piston compressor couples to the gas portion of the gas-liquid separator such that there is one-way fluid communication of the low-pressure gas from the gas-liquid separator to the liquid piston compressor and where the liquid portion of the liquid piston compressor couples to the liquids pump such that there is one-way fluid communication of the high-pressure liquid from the liquids pump to the liquid piston compressor;

the gas portion of the liquid piston compressor further couples to a production line such that there is one-way fluid communication of high-pressure gas from the liquid piston compressor to the production line; and the liquids pump couples to the production line such that there is communication of the high-pressure liquid from the liquids pump to the production line that bypasses the liquid piston compressor.

2. The system of claim 1 where the liquid portion of the liquid piston compressor also couples to the liquids pump such that there is one-way fluid communication of a reduced pressure liquid from the liquid piston compressor to the liquids pump.

3. The system of claim 1 where the liquid portion of the liquid piston compressor couples to the gas-liquid separator such that there is one-way fluid communication of a reduced pressure liquid from the liquid piston compressor to the gas-liquid separator.

4. The system of claim 1 where the system is operable to maintain the liquid piston compressor in a substantially isothermal condition.

5. The system of claim 4 where the substantially isothermal condition is maintained using the low-pressure liquid from the gas-liquid separator.

6. The system of claim 1 further comprising a liquid level controller that is operable to detect a liquid level within the liquid piston compressor.

7. The system of claim 6 where the liquid level controller is also operable to selectively permit an introduction of the high-pressure liquid into and to selectively permit the passing of a reduced pressure liquid from the liquid piston compressor.

8. The system of claim 7 where the liquid level controller is also operable to selectively permit an introduction of the low-pressure gas into and to selectively permit the passing of the high-pressure gas from the liquid piston compressor.

9. The system of claim 1 further comprising a temperature controller that is operable to detect a temperature within the liquid piston compressor.

10. The system of claim 9 where the temperature controller is also operable to selectively permit an introduction of a cooling liquid to the liquid piston compressor by way of the cooling liquid feed line.

11. The system of claim 1, where the shell fluid void is located inside the shell of the liquid piston compressor and is bound by an exterior surface of each of the plurality of liquid piston compressor tubes.

* * * * *